US012365370B2

(12) United States Patent
Wike et al.

(10) Patent No.: US 12,365,370 B2
(45) Date of Patent: Jul. 22, 2025

(54) RAILWAY VEHICLE COUPLER HAVING ROBUST KNUCKLE

(71) Applicant: Amsted Rail Company, Inc., Chicago, IL (US)

(72) Inventors: Paul Wike, St. Louis, MO (US); Tom Petrunich, Troy, IL (US); Matthew Todt, Highland, IL (US); Paul Sanders, Houghton, MI (US); Dale K. Dewald, Hancock, MI (US)

(73) Assignee: Amsted Rail Company, Inc., Chicago, IL (US)

( * ) Notice: Subject to any disclaimer, the term of this patent is extended or adjusted under 35 U.S.C. 154(b) by 838 days.

(21) Appl. No.: 17/585,982

(22) Filed: Jan. 27, 2022

(65) Prior Publication Data

US 2023/0234623 A1 Jul. 27, 2023

(51) Int. Cl.
*B61G 1/40* (2006.01)
*B61G 7/00* (2006.01)

(52) U.S. Cl.
CPC *B61G 1/40* (2013.01); *B61G 7/00* (2013.01)

(58) Field of Classification Search
CPC ..... B61G 1/40; B61G 1/42; B61G 7/00
See application file for complete search history.

(56) References Cited

U.S. PATENT DOCUMENTS 1,121,692 A * 12/1914 Van Dorn ..... B61G 3/04 213/153
4,055,254 A 10/1977 Chierici
4,605,133 A 8/1986 Altherr

OTHER PUBLICATIONS

Notification of Transmittal of the International Search Report and the Written Opinion of the International Searching Authority, or the Declaration for PCT/US2022/052209, dated Mar. 15, 2023.
R. Bowey & A. Shamdani, "Monitoring, managing and mitigating in-train forces", Proceedings of the 11th International Heavy Haul Association Conference (IHHA 2017), Cape Town, South Africa, Sep. 2-6, 2017, pp. 1007-1013.
Robert Boelen, et al, "Ore-car coupler performance at BHP-Billiton Iron Ore", Engineering Failure Analysis 11 (2004) pp. 221-234.

* cited by examiner

*Primary Examiner* — Robert J McCarry, Jr.
(74) *Attorney, Agent, or Firm* — Joseph M. Butscher; The Small Patent LAw Group LLC

(57) ABSTRACT

A knuckle of a coupler of a rail vehicle includes a main body including a recess formed in one or more surfaces. One or more weld fillers are disposed within the recess. A method of forming a knuckle of a coupler of a rail vehicle includes forming a recess in one or more surfaces of a main body, and disposing one or more weld fillers within the recess.

21 Claims, 6 Drawing Sheets

RAILWAY VEHICLE COUPLER HAVING ROBUST KNUCKLE

FIELD OF THE DISCLOSURE

Embodiments of the present disclosure generally relate to couplers for rail vehicles, such as rail cars, and, more particularly, to knuckles of couplers for rail vehicles.

BACKGROUND OF THE DISCLOSURE

Rail vehicles travel along railways, which have tracks that include rails. A rail vehicle includes one or more truck assemblies that support one or more car bodies.

Rail vehicles typically have couplers located at opposite ends to facilitate connection with the end of another rail vehicle of a train. The portions of each coupler that engage or contact one another are referred to as knuckles. Examples of coupler knuckles are described in U.S. Pat. Nos. 4,605,133, 4,090,615, and 5,582,307.

With increasing length and weight of a train, the potential of separation of train cars increases due to excess loading and fatigue of coupler knuckles. Such an issue can occur in regular train service, and can be prevalent in dedicated iron ore train service. For example, iron ore trains can include hundreds of railcars that have 50 percent greater capacity than general service cars. Railcar coupling systems are based on the Association of American Railroads standards, which typically require interchangeable parts. However, the fixed envelope of couplers limits allowable changes that can be performed to enhance knuckle endurance.

In general, a coupling system includes a coupler body and a knuckle that opens and locks in relation to a knuckle of another coupling system. The coupling system is configured for loads up to one million pounds in tension and compression. If the forces exceed capacity, the knuckle is designed to fail rather than damage other parts of the railcar. When a train separation occurs, the failed knuckle is replaced by train crew with spare knuckles that are carried on the train.

Trains, whether in transit or in an indexing loading/unloading faculty, have cars moving back and forth in compression or in tension. The continual wave of compression or tension can generate energy sweeping through the knuckle. Continuous cyclic loading can eventually fatigue the knuckle by reducing the life and the ability to achieve desired loading.

SUMMARY OF THE DISCLOSURE

A need exists for a knuckle of a coupler of a rail vehicle that is less susceptible to fatigue, damage, or failure. A need exists for a knuckle having increased strength.

With those needs in mind, certain embodiments of the present disclosure provide a knuckle of a coupler of a rail vehicle. The knuckle includes a main body including a recess formed in one or more surfaces. One or more weld fillers are disposed within the recess.

In at least one example, the one or more weld fillers are formed of a material that differs from the main body.

In at least one example, the one more weld fillers include a first weld filler. The main body is formed of a first metal, and the first weld filler is formed of a second metal having one or more properties that differ from the first metal. As a further example, the one or more weld fillers further include a second weld filler. The second weld filler is formed of a third metal having one or more properties that differ from the first metal and the second metal.

In at least one example, the main body is formed of a first metal having a first grain, and the one or more weld fillers are formed from a second metal having a second grain. The second grain is finer than the first grain.

In at least one example, the one or more surfaces include a rearward-facing surface of a leading beam. In at least one example, the one or more surfaces are configured to contact at least one surface of another knuckle of another rail vehicle.

In at least one example, the one or more weld fillers include a first weld filler disposed within the recess, wherein the first weld filler defines an interior recess. A second weld filler is disposed within the interior recess of the first weld filler. As an example, the main body is formed of a first metal, and the first weld filler is formed of a second metal that is at least 10 percent stronger than the first metal. As a further example, the second weld filler is formed of a third metal that is at least 20 percent stronger than the first metal.

In at least one example, the first weld filler separates the second weld filler from the main body. In at least one example, the second weld filler does not contact the main body.

Certain embodiments of the present disclosure provide a method of forming a knuckle of a coupler of a rail vehicle. The method includes forming a recess in one or more surfaces of a main body; and disposing one or more weld fillers within the recess.

DETAILED DESCRIPTION OF THE DISCLOSURE

Figure 1:
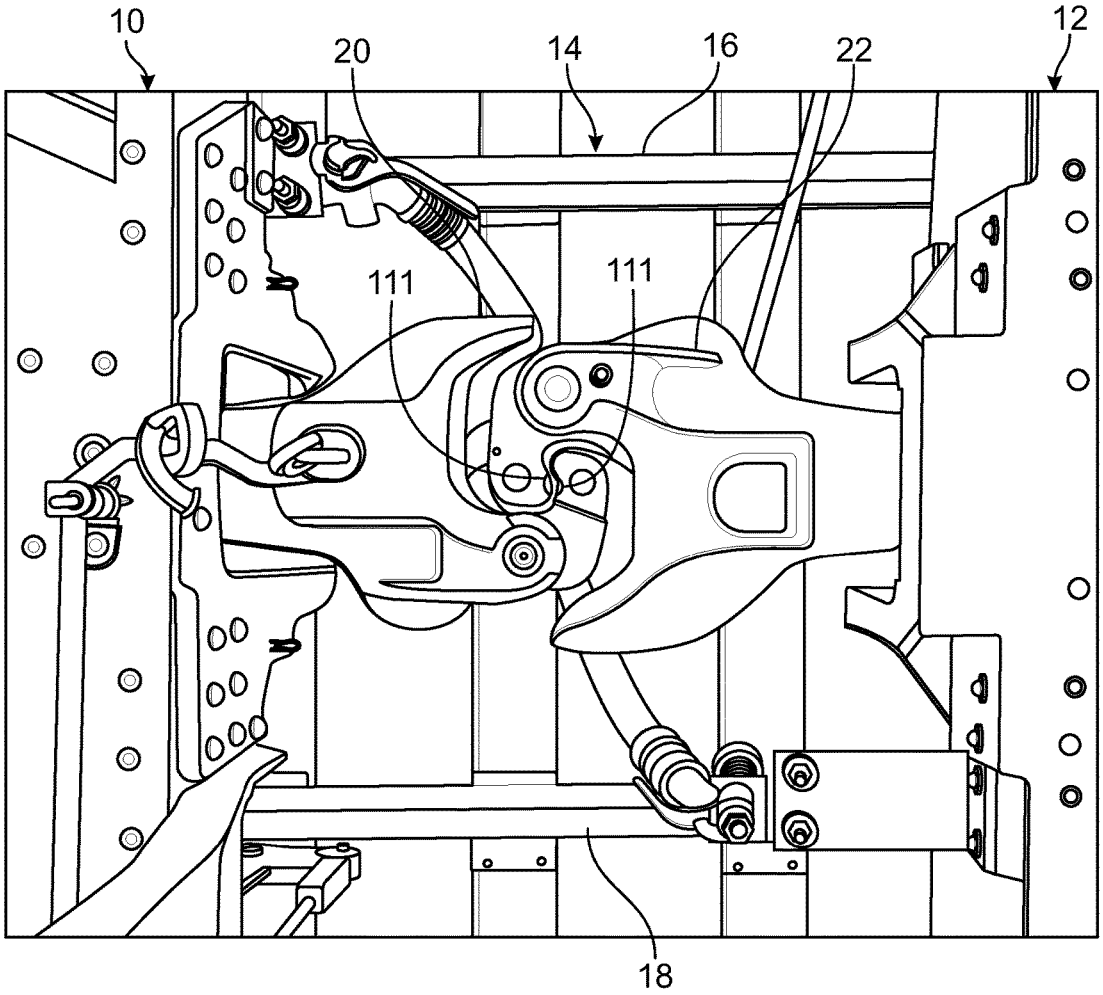
FIG. 1 illustrates a top view of a first rail car coupled to a second rail car.

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

The Association of American Railroads (AAR) adopted a fatigue-testing standard (AAR M-216) in 2009 and began enforcing the requirements in 2016. Before that time, concerns with knuckle life were primarily limited to wear on mating knuckle contact surfaces, as evident by use of gauges 25623-1 and 44057 in AAR Field Manual Rule 16 and gauges 47120-2, 49822, and 44250-3 in AAR Field Manual Rule 18. The new focus on fatigue life for the knuckles resulted in study of failure modes and fracture mechanics that had not previously occurred. Embodiments of the present disclosure address these issues, among others.

As described herein, a knuckle of a coupler of a rail vehicle includes a main body including a recess. One or more weld fillers are disposed within the recess. In at least one example, the one or more weld fillers are formed of a material that differs from the main body. For example, the main body is formed of a first metal, and a weld filler is formed of a second metal having one or more properties that differ from the first metal.

A knuckle of a coupling system is subjected to bending loads at outer fibers of the knuckle body. Repeated tension and compression above material endurance limit can generate loads that affect fatigue life of the knuckle. Accordingly, certain embodiments of the present disclosure increase endurance of the knuckle by removing casting imperfections in fatigue prone areas. Such imperfections include decarburization lay, corrosion, and porosity, which can affect the endurance of cast knuckles. In at least one example of the present disclosure, the knuckle is cast having material removed to create (or optionally, integrally molded and cast having) a recessed area for weld material to be added. The weld filler is a metal having properties that can be similar, but not the same, as the parent casting properties. In at least one example, the weld filler includes additives to increase strength, and reduce corrosion.

Decarburization is a metallurgical process in which the surface of steel is depleted of carbon, by being heated above a lower critical temperature. Decarburization layer is at the boundary of the outer fiber and creates a non-uniform layer between itself and the outer fiber of the parent metal. The lower strength decarburization layer is more prone to fatigue crack propagation than the parent metal. Once a crack is initiated in the decarburization layer, it can continue to propagate through the parent metal.

Once a fatigue crack propagation occurs in a casting, a path for corrosion stress is established. When metal is exposed to a corrosive stress, failure can occur at lower loads over a relatively very short time.

Porosity occurs when molten feed metal cannot be delivered quick enough and gas voids are formed. When porosity occurs toward the outer fibers in the load carrying path, the outer fibers can become subject to high stress and have a potential to initiate fatigue propagation.

Certain examples of the present disclosure replace the casting in higher stressed fatigue prone areas of a knuckle with weld filler. The weld filler minimizes or otherwise reduces the number of imperfections within fatigue prone areas.

The weld filler that replaces casting material eliminates, minimizes, or otherwise reduces decarburizations.

In at least one example, the weld filler is applied (for example, deposited) by a robot, such as via wire arc additive manufacturing. The robot accurately and uniformly applies each weld layer. The casting (that is, the main body of the knuckle) becomes a heat sink for the metal of the weld filler, thereby providing uniform cooling and solidification. The uniform cooling provides even shrinkage and eliminates, minimizes, or otherwise reduces voids and/or porosity.

In at least one example, the weld filler is a metal having a finer grain than that of the main body of the knuckle. For example, the main body of the knuckle is formed from a metal having a first grain, and the weld filler is a metal having a second grain, which is finer than the first grain. The finer grain of the weld filler makes it less susceptible to creasing a path for a crack to initiate. Further, the deposit direction of the weld filler metal, finish grind direction, and grinding finish increase the overall strength of the weld reinforced area.

In at least one other example of the present disclosure, endurance of the knuckle is increased by locally increasing the strength of the outer fiber of the knuckle body. The higher material strength increases the material endurance limit, which in turn increases the fatigue life of the knuckle. The knuckle has material removed to create a recessed area for weld material to be added. The recessed area is filled half way in the center and over-filled at the edges with a robotic welding process using filler metal that is stronger (such as 10-20 percent stronger) than the parent metal of the casting. The rest of the fill is performed by a robotic welding process that over-fills the center section. The over-filled weld metal is ground to the finish size. The upper filler metal can be 20 percent stronger than the parent metal of the casting. In at least one example, the upper filler metal only contacts the lower filler metal and not the parent metal of the casting. The layering of the filler metal and mixing of the metal fronts that occurs during the welding process ensures that the transition of one strength material to the next is not large enough to create shear or bending crack propagation at the interfaces.

FIG. 1 illustrates a top view of a first rail car 10 coupled to a second rail car 12. The first rail car 10 and the second rail car 12 are configured to travel along a track 14 having rails 16 and 18. A coupler 20 of the first rail car 10 connects to a coupler 22 of the second rail car 12.

Figure 2:
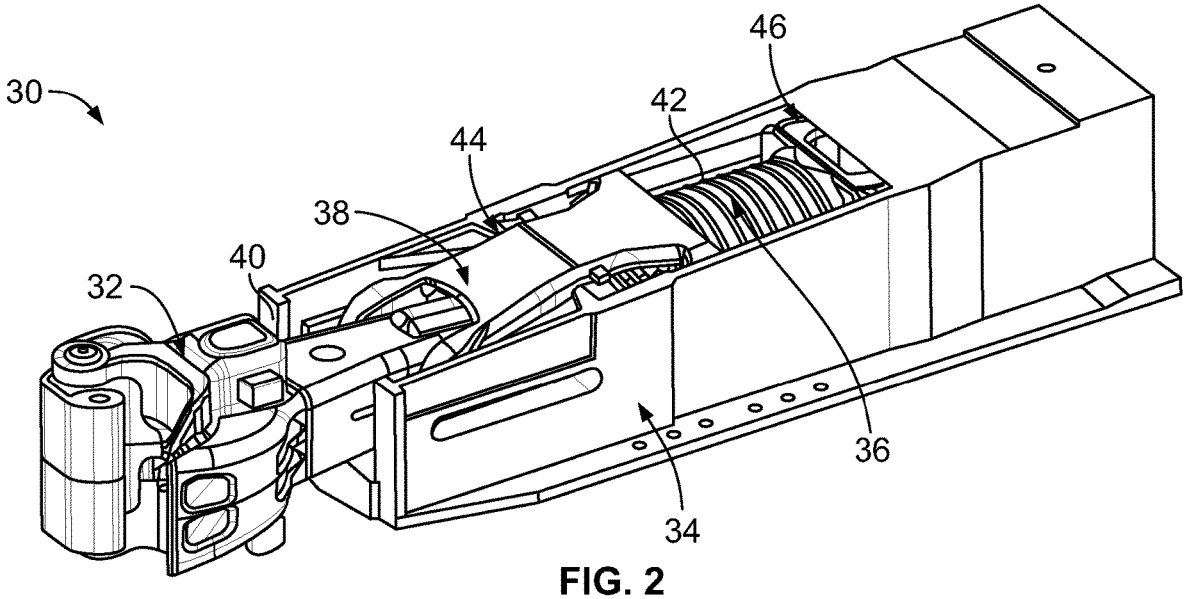
FIG. 2 illustrates a perspective top view of a car coupling system.

FIG. 2 illustrates a perspective top view of a car coupling system 30. The first rail car 10 and the second rail car 12 (shown in in FIG. 1) include a car coupling system 30. The car coupling system 30 includes a coupler 32 (such as the coupler 20 or the coupler 22 shown in FIG. 1), a draft sill 34, and a draft gear 36 with yoke 38. The coupler 32 is supported at a first end 40 by the draft sill 34 and at an opposite second end 42 by the draft gear 36 or cushion unit with the yoke 38. The draft gear 42 or cushion unit is constrained within the draft sill 34 by a pair of front stops 44 and a pair of rear stops 46.

Figure 3:
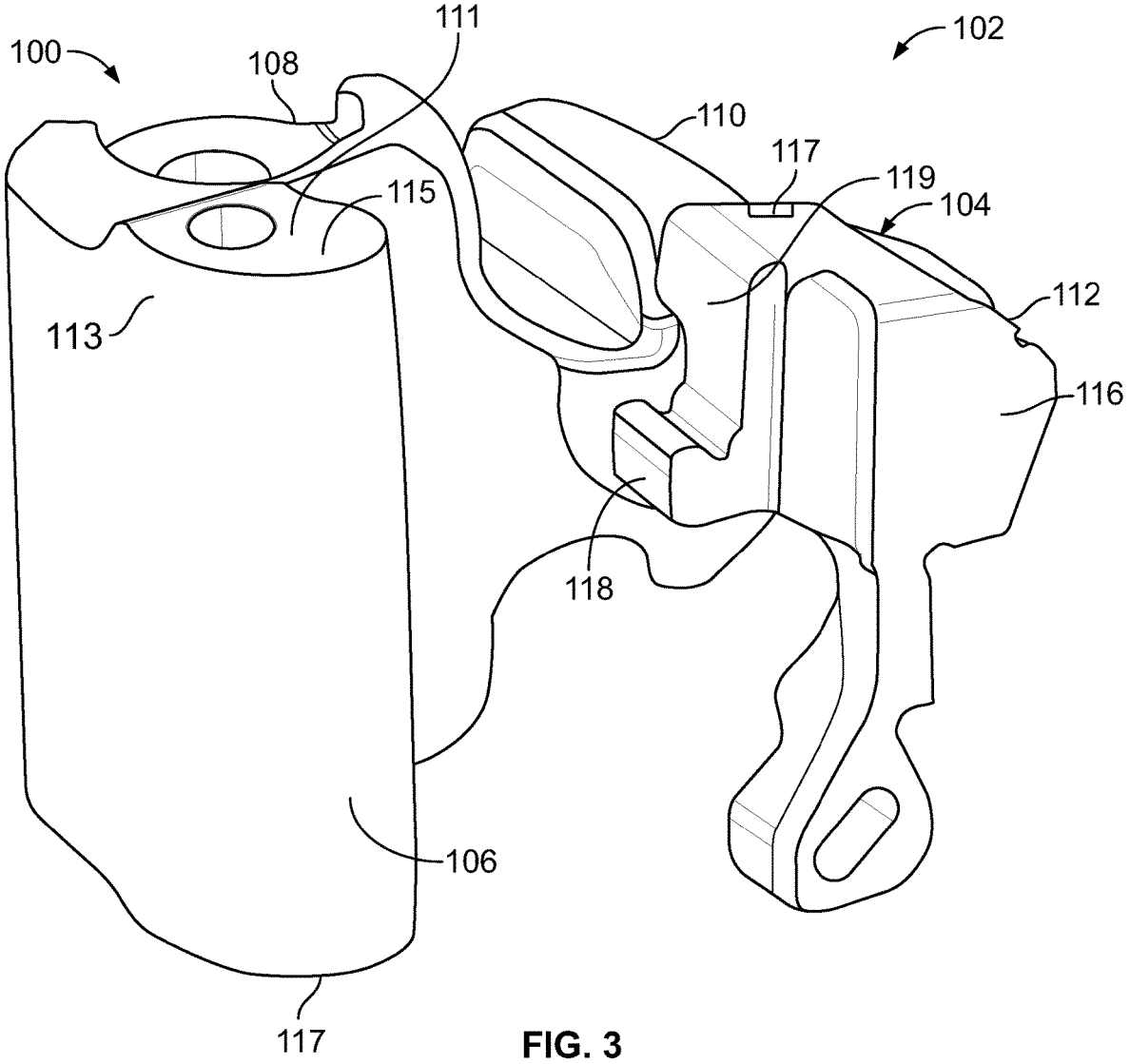
FIG. 3 illustrates a perspective lateral view of a knuckle of a coupler of rail vehicle, according to an embodiment of the present disclosure.

FIG. 3 illustrates a perspective lateral view of a knuckle 100 of a coupler 102 of rail vehicle, according to an embodiment of the present disclosure. The knuckle 100 engages a lock 104.

The knuckle 100 includes a leading beam 106 that connects to a lateral offset beam 108. The lateral offset beam 108 extends from the leading beam 106. A tail 110 extends from the lateral offset beam 108. For example, the tail 110 is a trailing portion of the lateral offset beam 108. The tail 110 engages the lock 104.

The lock 104 includes a main body 112 having an interior face (hidden from view in FIG. 3), an exterior face 116, and a nose 118 forwardly extending from the main body 112. At least a portion of the interior face contacts the tail 110 of the knuckle 100.

The knuckle 100 includes various surfaces that can be reinforced with a weld filler. For example, one or more recesses can be formed in exposed surfaces of the knuckle. The weld filler is deposited into the recess(es). In at least one example, the weld filler is disposed within one or more recesses formed in surfaces that are configured to contact a counterpart surface of another knuckle. For example, a recess can be formed in a rearward-facing surface 111 of the leading beam 106. Referring to FIGS. 1 and 3, the rearward-facing surface 111 of a knuckle 100 of the first rail car 10 is configured to directly contact a rearward-facing surface of a leading beam 106 of a knuckle 100 of the second rail car 12.

Referring again to FIG. 1, the rearward-facing surface 111 is one example of a surface of the knuckle 100 that can be reinforced with a weld filler disposed within a recess. Other examples include a forward-facing surface 113, a top surface 115, a bottom surface 117, one or more surfaces of the lock 117, 119, and/or the like. In general, various surfaces of the knuckle 100 that can be susceptible to fatigue can be reinforced by a weld filler disposed within a recess formed in the surface(s).

Figure 4:
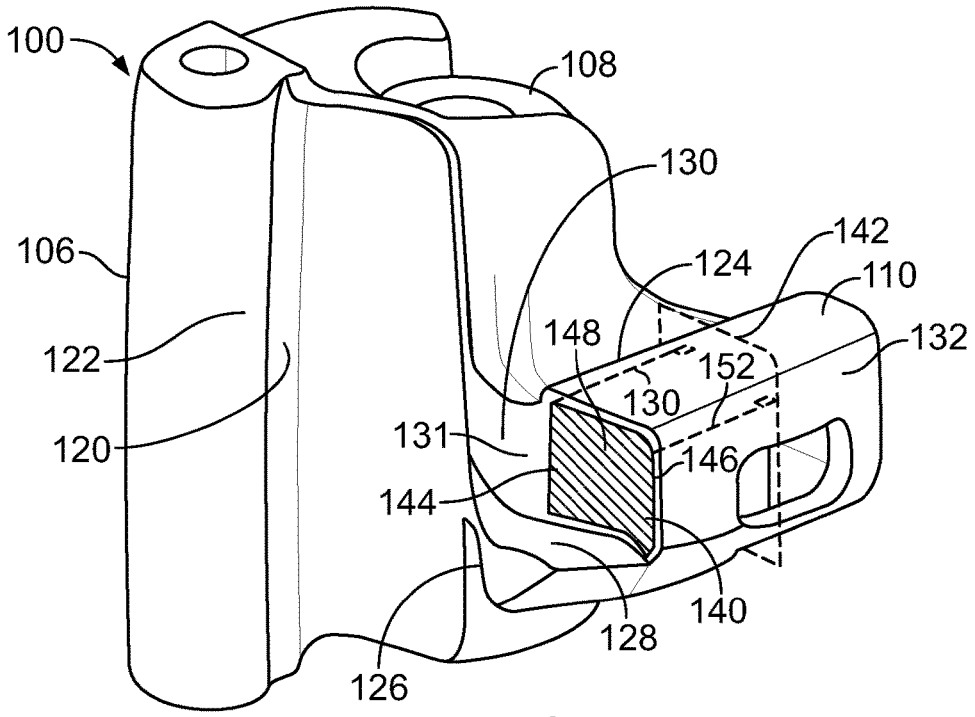
FIG. 4 illustrates a perspective lateral view of the knuckle, according to an embodiment of the present disclosure.

FIG. 4 illustrates a perspective lateral view of the knuckle 100, according to an embodiment of the present disclosure. The leading beam 106 includes a pulling face 120 at a rear surface 122. The tail 110 includes a top pulling lug 124, a bottom pulling lug 126, and a lock shelf 128 over the bottom pulling lug 126. An extension wall 130 extends from the lateral offset beam 108 towards an end 132 of the tail 110.

In at least one example, a tapered lock engagement wall 140 extends from the extension wall 130 to the end 132. The tapered lock engagement wall 140 is further described in U.S. patent application Ser. No. 16/716,564, entitled "Railway Vehicle Coupler," filed Dec. 17, 2019, which is hereby incorporated by reference in its entirety. Unlike conventional knuckles that have lock contact surfaces defined by a flat surface that is in the same plane as a lateral surface 131 of the extension wall 130, the tapered lock engagement wall 140 angles inwardly towards a central longitudinal plane 142 of the tail 110. For example, the tapered lock engagement wall 140 includes a front edge 144 that connects to a rear edge 146 through a flat surface 148. The front edge 144 is located a first perpendicular distance from the central longitudinal plane 142, and the rear edge 146 is located a second perpendicular distance 152 from the central longitudinal plane 142. The first perpendicular distance is greater than the second perpendicular distance 152. In this manner, the flat surface 148 recedes or tapers away from a plane of the lateral surface 131 of the extension wall 130. As such, the flat surface 148 of the tapered lock engagement wall 140 is out of plane in relation to the lateral surface 131 of the extension wall 130.

Optionally, the knuckle 100 may not include the tapered lock engagement wall 140. Instead, the knuckle 100 can have lock contact surfaces defined by a flat surface that is in the same plane as the lateral surface 131 of the extension wall 130.

As described herein, one or more recesses can be formed in various portions of the knuckle 100, such as the pulling face 120 at the rear surface 122, one or more portions of the tail 110, one or more portions of the lateral offset beam 108, and/or the like. Weld filler is deposited and secured within the one or more recesses, thereby increasing endurance and strength of the knuckle 100.

Figure 5:
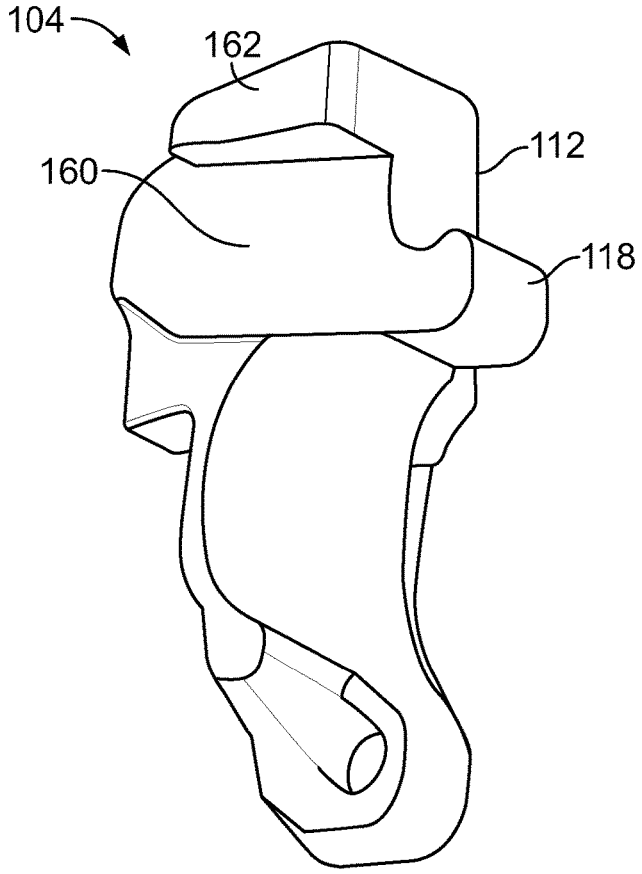
FIG. 5 illustrates a perspective interior lateral view of a lock, according to an embodiment of the present disclosure.

FIG. 5 illustrates a perspective interior lateral view of the lock 104, according to an embodiment of the present disclosure. The main body 112 includes the interior face 160. The interior face 160 defines a knuckle-engaging surface that is configured to bear or otherwise abut against the tapered lock engagement wall 140 (shown in FIG. 4) of the knuckle 100. The interior face 160 provides a flat surface. A top ledge 162 inwardly extends over and is laterally inward in relation to the interior face 160. Various portions of the lock 104 can include one or more recesses having weld filler, as described herein.

Figure 6:
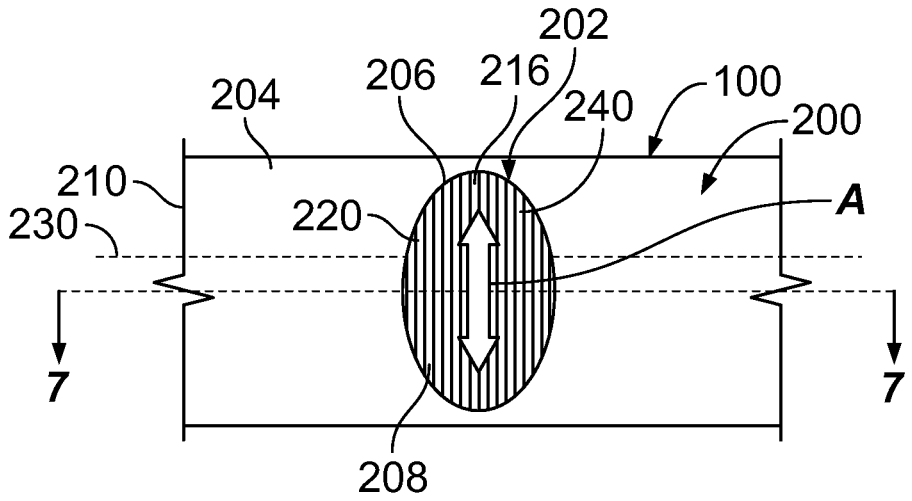
FIG. 6 illustrates a front view of a surface of a knuckle, according to an embodiment of the present disclosure.

FIG. 6 illustrates a front (or optionally, rear or side, depending on orientation) view of a surface 200 of the knuckle 100, according to an embodiment of the present disclosure. For example, the surface 200 can be the rearward-facing surface 111 shown in FIG. 3. Other examples of the surface 200 include the forward-facing surface 113, the top surface 115, the bottom surface 117, one or more surfaces of the lock 104, 119, and/or the like, shown in FIG. 3. Various surfaces of the knuckle 100 that can be susceptible to fatigue can be reinforced by a weld filler disposed within a recess formed in the surface(s). As another example, the surface 200 can be or include the pulling face 120 at the rear surface 122, one or more portions of the tail 110, one or more portions of the lateral offset beam 108, and/or the like, as shown in FIG. 4. As another example, the surface 200 can be or include one or more surfaces of the lock 104, as shown in FIG. 5.

Figure 7:
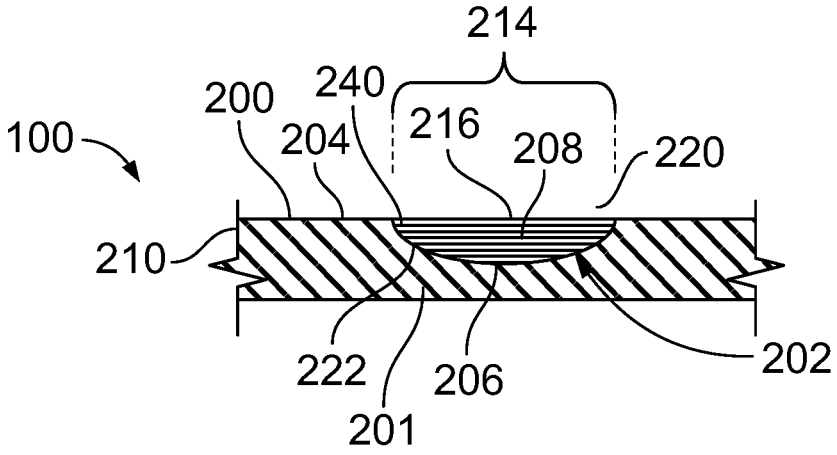
FIG. 7 illustrates a cross-sectional view of the surface of the knuckle through line 7-7 of FIG. 6.

FIG. 7 illustrates a cross-sectional view of the surface 200 of the knuckle 100 through line 7-7 of FIG. 6. Referring to FIGS. 6 and 7, a recess 202 is formed in the surface 200. The recess 202 provides an indentation, cavity, channel, or the like that inwardly extends from an outer envelope 204 of the surface 200. For example, the recess 202 can be inwardly offset a desired distance from the outer envelope 204. The desired distance can be between 0.1-2 inches, for example. In at least one example, the recess 202 can be 0.5 inches or less inward from the outer envelope 204. The recess 202 has a support base 206, which can be arcuate. For example, the support base 206 can be an arcuate basin. Optionally, the support base 206 can be linearly-shaped.

The knuckle 100 is cast having a reduced wall section 201 that defines the recess 202. The recess 202 is configured to retain a weld filler 208. The weld filler 208 is deposited into the recess 202, such as by a robot. The weld filler 208 can be disposed within the recess 202 by a robot, such as via wire arc additive manufacturing.

The knuckle 100 is formed from a first material, such as via cast molding. For example, the surface 200 is part of a main body 210 of the knuckle 100 formed of a first metal. The first metal can be an alloy, such as low carbon cast steel. The weld filler 208 is formed of a second metal that differs from the first metal. For example, the second metal can be a steel arc weld having different properties than the first metal.

For example, the weld filler 208 is formed of a metal having properties that are similar to the main body 210 (for example, the parent cast metal), but having one or more additives that increase strength and reduce corrosion. In at least one example, the recess 202 having the weld filler 208 disposed therein is along a high stress fatigue area 214, such as an area that is configured to engage a portion of another knuckle. In at least one example, the high stress fatigue area 214 is disturbed along an outer fiber 216 of the weld filler 208.

In at least one example, the weld filler 208 has a first grain that differs from a second grain of the main body 210. In particular, the first grain is finer than the second grain. The weld filler 208 has the first grain (that is, the finer grain) at a crown 220 (for example, an exposed outer portion) and a root 222 (for example, an interior portion that rests against the recess 202).

The weld filler 208 can be deposited in a direction A. The direction A of the deposition of the weld filler 208 can be vertical, for example. In at least one example, the direction A of the deposition is orthogonal to a lateral axis 230. An outer surface 240 of the weld filler 208 can be ground to be flush with the outer envelope 204 of the main body 210 of the knuckle 200. It has been found that the direction A of weld deposition, and grinding the weld filler 208 to be flush with the outer envelope 204 increases the overall integrity of welded surface.

The weld filler 208 within the recess 202 increases the strength and endurance of the knuckle 100 by removing and replacing casting imperfections in fatigue prone areas, such as the area 214. The knuckle 100 is cast having material removed to create the recess 202 into which the weld filler 208 is added. The weld filler 208 minimizes or otherwise reduces the number of imperfections within fatigue prone areas.

In at least one example, the weld filler 208 is applied by a robot, such as via wire arc additive manufacturing. The robot accurately and uniformly applies each weld layer. The main body 210 of the knuckle 100 provides a heat sink for the weld filler 208, thereby providing uniform cooling and solidification. The uniform cooling provides even shrinkage and eliminates, minimizes, or otherwise reduces voids and/or porosity.

Figure 8:
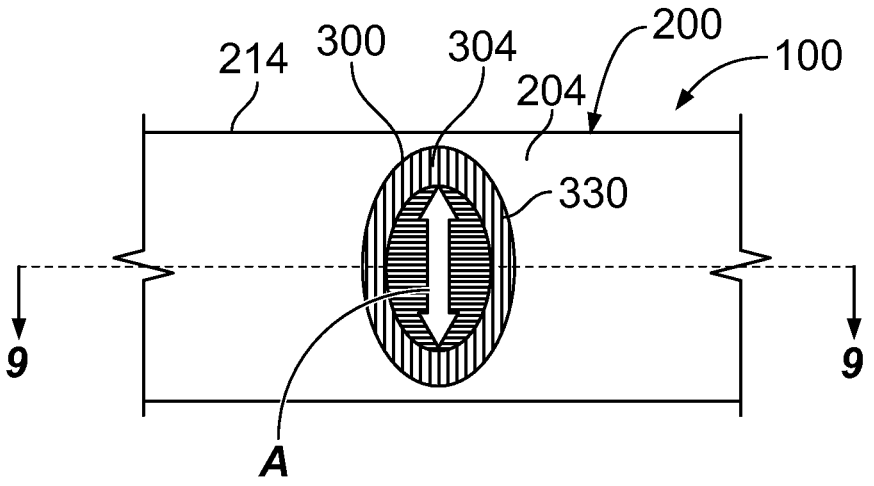
FIG. 8 illustrates a front view of a surface of a knuckle, according to an embodiment of the present disclosure.
Figure 9:
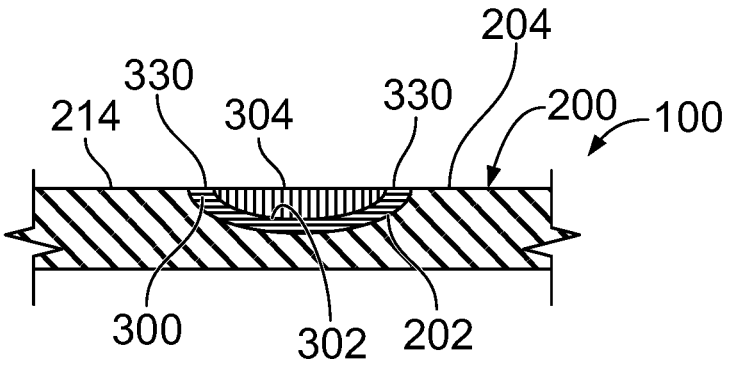
FIG. 9 illustrates a cross-sectional view of the surface of the knuckle through line 9-9 of FIG. 8.

FIG. 8 illustrates a front (or optionally, rear or side, depending on orientation) view of a surface 200 of the knuckle 100, according to an embodiment of the present disclosure. FIG. 9 illustrates a cross-sectional view of the surface 200 of the knuckle 100 through line 9-9 of FIG. 8. Referring to FIGS. 8 and 9, the recess 202 is formed in the surface 200, as described above. In this embodiment, a first weld filler and a second weld filler are disposed within the recess 202.

For example, a first weld filler 300 is disposed within the recess 202 to a desired depth. The first weld filler 300 is formed of a material that differs from the material of the main body 210. For example, the first weld filler metal 300 can be formed of a metal that is 10 percent stronger than the metal of the main body 210. The first weld filler 300 can be deposited by a robot, such as via wire arc additive manufacturing. The first weld filler 300 partially fills the recess 202 to a depth below the outer envelope 204, thereby providing an interior recess 302. A second weld filler 304 is deposited into the interior recess 302 formed by an outer surface of the first weld filler 300. The second weld filler 304 can be deposited by a robot, such as via wire arc additive manufacturing. The second weld filler 304 can be formed of a different material than the first weld filler 300 and the main body 214. For example, the second weld filler 304 can be formed of a metal that is 20 percent stronger than the metal of the main body 214.

In at least one example, the second weld filler 304 can over-fill the recess 202, such that it extends outwardly past the outer envelope 204. The over-filled portion can be ground back, so as to be flush with the outer envelope 204.

In at least one example, the first weld filler 300 has an interior outer edge 330 that is flush with the outer envelope 204 of the main body 214. The interior outer edge 330 (as well as the remainder) of the first weld filler 300 separates the second weld filler 304 from the main body 214, thereby ensuring that the second weld filler 304 does not contact the main body 214. Instead, the first weld filler 300 provides a buffer between the main body 214 and the second weld filler 304. The layering of the first weld filler 300 and the second weld filler 304, and interfaces of the metal fronts that occurs during the welding process ensures that transition of one strength material to the next is not large enough to create shear or bending crack propagation at the interfaces.

Endurance of the knuckle 100 is increased by locally increasing the strength of the outer fiber of the main body 214. The higher material strength increases the material endurance limit, which in turn increases the fatigue life of the knuckle 100. The knuckle 100 has material removed to create the recess 202 for weld material to be added. In at least one example, the recess 202 is filled half way in the center and over-filled at the edges with a robotic welding process using filler metal that is stronger (such as 10-20 percent stronger) than the parent metal of the casting. The rest of the fill is performed by a robotic welding process that over-fills the center section. The over-filled weld metal is ground to the finish size.

Accordingly, in at least one example, the main body 214 is formed of a first metal. The first weld filler 300 is formed of a second metal having one or more properties that differ from the first metal (that is, one or more properties that are different than one or more properties of the first metal). The second weld filler 304 is formed of a third metal having one or more properties that differ from the first metal and the second metal (that is, one or more properties that are different than those of the first metal and the second metal).

Figure 10:
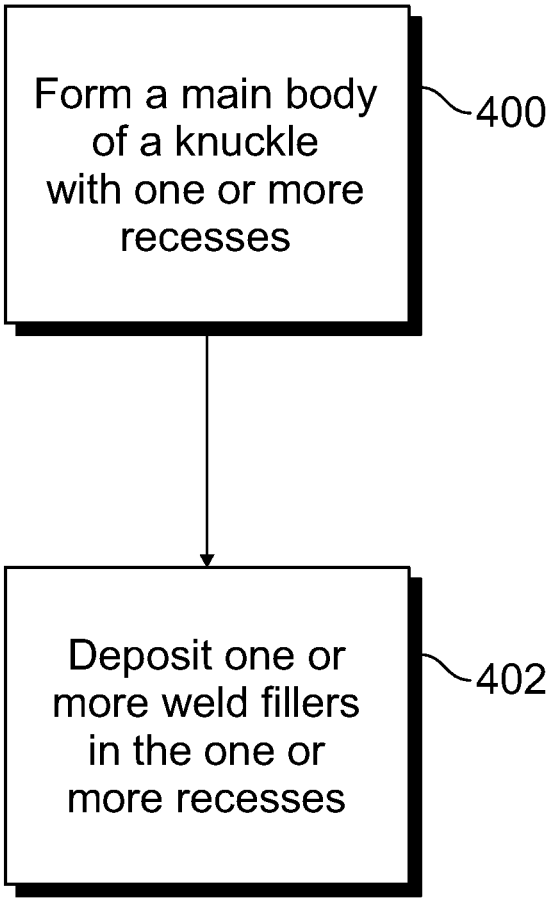
FIG. 10 illustrates a flow chart of a method of forming a knuckle of a coupling system, according to an example of the present disclosure.

FIG. 10 illustrates a flow chart of a method of forming a knuckle of a coupling system, according to an example of the present disclosure. The method includes forming, at 400, a main body (such as the main body 214) of a knuckle with one or more recesses. For example, the main body 214 can be cast from a first metal. At 402, one or more weld fillers are deposited in the one or more recesses. The weld filler(s) are formed from a different material than the main body. For example, the weld filler(s) are formed from one or more metals that are different from the metal of the main body. A robot can deposit the weld fillers within the one or more recesses, such as via wire arc additive manufacturing.

Further, the disclosure comprises embodiments according to the following clauses:

Clause 1. A knuckle of a coupler of a rail vehicle, the knuckle comprising:

a main body comprising a recess formed in one or more surfaces; and one or more weld fillers disposed within the recess.

Clause 2. The knuckle of Clause 1, wherein the one or more weld fillers are formed of a material that differs from the main body.

Clause 3. The knuckle of Clauses 1 or 2, wherein the one more weld fillers comprise a first weld filler, wherein the main body is formed of a first metal, and wherein the first weld filler is formed of a second metal having one or more properties that differ from the first metal.

Clause 4. The knuckle of Clause 3, wherein the one or more weld fillers further comprise a second weld filler, and wherein the second weld filler is formed of a third metal having one or more properties that differ from the first metal and the second metal.

Clause 5. The knuckle of any of Clauses 1-4, wherein the main body is formed of a first metal having a first grain, wherein the one or more weld fillers are formed from a second metal having a second grain, and wherein the second grain is finer than the first grain.

Clause 6. The knuckle of any of Clauses 1-5, wherein the one or more surfaces comprise a rearward-facing surface of a leading beam.

Clause 7. The knuckle of any of Clauses 1-6, wherein the one or more surfaces are configured to contact at least one surface of another knuckle of another rail vehicle.

Clause 8. The knuckle of any of Clauses 1-7, wherein the one or more weld fillers comprise:

a first weld filler disposed within the recess, wherein the first weld filler defines an interior recess; and a second weld filler disposed within the interior recess of the first weld filler.

Clause 9. The knuckle of Clause 8, wherein the main body is formed of a first metal, wherein the first weld filler is formed of a second metal that is at least 10 percent stronger than the first metal, and wherein the second weld filler is formed of a third metal that is at least 20 percent stronger than the first metal.

Clause 10. The knuckle of Clauses 8 or 9, wherein the first weld filler separates the second weld filler from the main body.

Clause 11. The knuckle of any of Clauses 8-10, wherein the second weld filler does not contact the main body.

Clause 12. A method of forming a knuckle of a coupler of a rail vehicle, the method comprising:

forming a recess in one or more surfaces of a main body; and disposing one or more weld fillers within the recess.

Clause 13. The method of Clause 12, further comprising forming the one or more weld fillers of a material that differs from the main body.

Clause 14. The method of Clauses 12 or 13, further comprising:

forming the main body of a first metal; and forming a first weld filler of a second metal having one or more properties that differ from the first metal.

Clause 15. The method of Clause 14, further comprising forming a second weld filler of a third metal having one or more properties that differ from the first metal and the second metal.

Clause 16. The method of any of Clauses 12-15, further comprising:

forming the main body of a first metal having a first grain; and forming the one or more weld fillers from a second metal having a second grain that is finer than the first grain.

Clause 17. The method of any of Clauses 12-16, wherein the one or more surfaces comprise a rearward-facing surface of a leading beam.

Clause 18. The method of any of Clauses 12-17, wherein said disposing comprises:

disposing a first weld filler within the recess, wherein the first weld filler defines an interior recess; and disposing a second weld filler within the interior recess of the first weld filler.

Clause 19. The method of Clause 18, wherein the first weld filler separates the second weld filler from the main body, and wherein the second weld filler does not contact the main body.

Clause 20. A knuckle of a coupler of a rail vehicle, the knuckle comprising:

a main body comprising a recess formed in a rearward-facing surface of a leading beam; and one or more weld fillers disposed within the recess, wherein the one or more weld fillers are formed of a material that differs from the main body, wherein the one more weld fillers comprise a first weld filler, wherein the main body is formed of a first metal, and wherein the first weld filler is formed of a second metal having one or more properties that differ from the first metal, and wherein the first metal has a first grain, wherein the second metal has a second grain that is finer than the first grain.

Clause 21. The knuckle of Clause 20, wherein the one or more weld fillers further comprise a second weld filler, and wherein the second weld filler is formed of a third metal having one or more properties that differ from the first metal and the second metal.

As described herein, embodiments of the present disclosure provide a knuckle of a coupler of a rail vehicle that is less susceptible to fatigue, damage, or failure. Moreover, embodiments of the present disclosure provide a knuckle having increased strength.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

The invention claimed is:

1. A knuckle of a coupler of a rail vehicle, the knuckle comprising:

a main body comprising a recess formed in one or more surfaces; and one or more weld fillers disposed within the recess, wherein the one or more weld fillers are welded to the main body within the recess.

2. The knuckle of claim 1, wherein the one or more weld fillers are formed of a material that differs from the main body.

3. The knuckle of claim 1, wherein the one more weld fillers comprise a first weld filler, wherein the main body is formed of a first metal, and wherein the first weld filler is formed of a second metal having one or more properties that differ from the first metal.

4. The knuckle of claim 3, wherein the one or more weld fillers further comprise a second weld filler, and wherein the second weld filler is formed of a third metal having one or more properties that differ from the first metal and the second metal.

5. The knuckle of claim 1, wherein the main body is formed of a first metal having a first grain, wherein the one or more weld fillers are formed from a second metal having a second grain, and wherein the second grain is finer than the first grain.

6. The knuckle of claim 1, wherein the one or more surfaces comprise a rearward-facing surface of a leading beam.

7. The knuckle of claim 1, wherein the one or more surfaces are configured to contact at least one surface of another knuckle of another rail vehicle.

8. The knuckle of claim 1, wherein the one or more weld fillers comprise:

a first weld filler disposed within the recess, wherein the first weld filler defines an interior recess; and a second weld filler disposed within the interior recess of the first weld filler.

9. The knuckle of claim 8, wherein the main body is formed of a first metal, wherein the first weld filler is formed of a second metal that is at least 10 percent stronger than the first metal, and wherein the second weld filler is formed of a third metal that is at least 20 percent stronger than the first metal.

10. The knuckle of claim 8, wherein the first weld filler separates the second weld filler from the main body.

11. The knuckle of claim 8, wherein the second weld filler does not contact the main body.

12. A method of forming a knuckle of a coupler of a rail vehicle, the method comprising:

forming a recess in one or more surfaces of a main body; and disposing one or more weld fillers within the recess, wherein said disposing comprises welding the one or more weld fillers to the main body within the recess.

13. The method of claim 12, further comprising forming the one or more weld fillers of a material that differs from the main body.

14. The method of claim 12, further comprising:

forming the main body of a first metal; and forming a first weld filler of a second metal having one or more properties that differ from the first metal.

15. The method of claim 14, further comprising forming a second weld filler of a third metal having one or more properties that differ from the first metal and the second metal.

16. The method of claim 12, further comprising:

forming the main body of a first metal having a first grain; and forming the one or more weld fillers from a second metal having a second grain that is finer than the first grain.

17. The method of claim 12, wherein the one or more surfaces comprise a rearward-facing surface of a leading beam.

18. The method of claim 12, wherein said disposing comprises:

disposing a first weld filler within the recess, wherein the first weld filler defines an interior recess; and disposing a second weld filler within the interior recess of the first weld filler.

19. The method of claim 18, wherein the first weld filler separates the second weld filler from the main body, and wherein the second weld filler does not contact the main body.

20. A knuckle of a coupler of a rail vehicle, the knuckle comprising:

a main body comprising a recess formed in a rearward-facing surface of a leading beam; and one or more weld fillers disposed within the recess, wherein the one or more weld fillers are welded to the main body within the recess, wherein the one or more weld fillers are formed of a material that differs from the main body, wherein the one more weld fillers comprise a first weld filler, wherein the main body is formed of a first metal, and wherein the first weld filler is formed of a second metal having one or more properties that differ from the first metal, and wherein the first metal has a first grain, wherein the second metal has a second grain that is finer than the first grain.

21. The knuckle of claim 20, wherein the one or more weld fillers further comprise a second weld filler, and wherein the second weld filler is formed of a third metal having one or more properties that differ from the first metal and the second metal.

* * * * *